US008701915B2

(12) United States Patent
Stevenson

(10) Patent No.: US 8,701,915 B2
(45) Date of Patent: Apr. 22, 2014

(54) EASY GRIP, READILY REMOVABLE AND REUSABLE SELF-LOCKING OIL PAN PLUG

(76) Inventor: Dennis Stevenson, Bradenton, FL (US)

( * ) Notice: Subject to any disclaimer, the term of this patent is extended or adjusted under 35 U.S.C. 154(b) by 432 days.

(21) Appl. No.: 12/786,394

(22) Filed: May 24, 2010

(65) Prior Publication Data

US 2011/0284539 A1 Nov. 24, 2011

(51) Int. Cl.
*B65D 53/00* (2006.01)

(52) U.S. Cl.
USPC ..... 220/233; 220/378; 220/801; 220/235; 285/277

(58) Field of Classification Search
USPC ..... 220/233, 801, 803, 378, 234, 235; 29/505; 285/277, 86; 138/89
See application file for complete search history.

(56) References Cited

U.S. PATENT DOCUMENTS 3,423,110 A * 1/1969 Hansen et al. ..... 285/277
4,205,758 A * 6/1980 Johnson ..... 220/235

* cited by examiner

*Primary Examiner* — David Fidei
*Assistant Examiner* — Raven Collins
(74) *Attorney, Agent, or Firm* — McNeely, Hare & War LLP; William D. Hare, Esq

(57) ABSTRACT

Provided herein is an oil pan plug assembly having an elongated sleeve and a plug member. The elongated sleeve includes first and second ends and defines a longitudinal drain bore therethrough having corresponding first and second end portions, the second end of the sleeve configured to project outwardly from the exterior of the oil pan through an opening in the oil pan disposed about the sleeve, and a securement means for forming a fluid-tight seal through the opening in the oil pan when the sleeve is mounted in the oil pan. The plug member defines a head including an axially projecting skirt with a first and a second end, an adjacent, axially projecting locking sleeve having a first end, a second end, a middle section between the first and second ends having an outer diameter that is less than one or both of the first end and the second end, the locking sleeve surrounding the skirt and being telescoped over the skirt to releasably secure the plug member to the elongated sleeve by slidable lengthwise retraction from the sleeve bore, the plug member further comprising an elongated shank projecting length wise outwardly from one side of said enlarged head and removably telescopingly received in the longitudinal bore second end portion of the elongated sleeve.

20 Claims, 8 Drawing Sheets

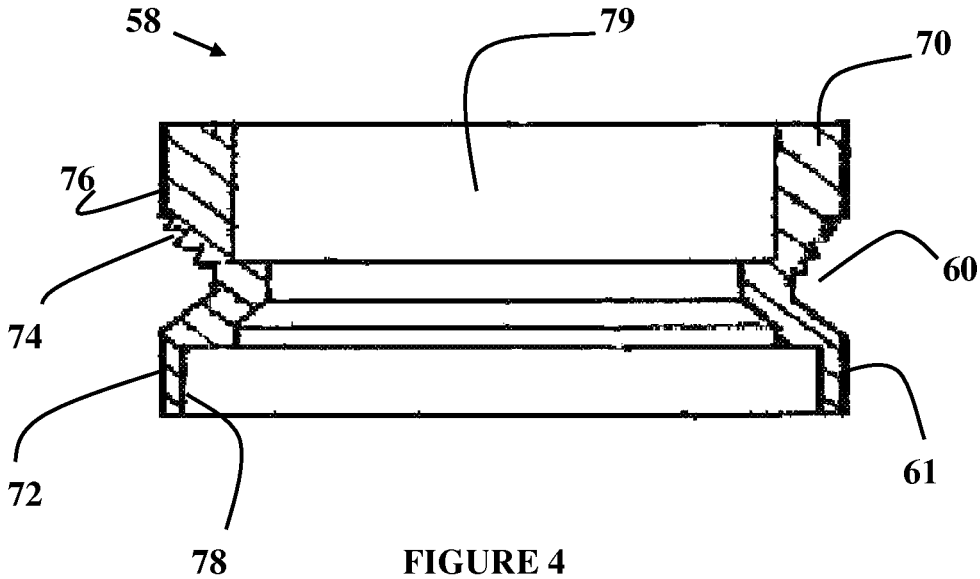
FIGURE 4
Fig. 5
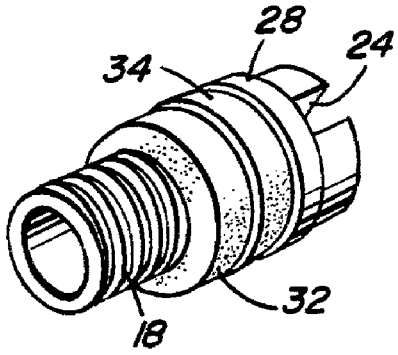

EASY GRIP, READILY REMOVABLE AND REUSABLE SELF-LOCKING OIL PAN PLUG

TECHNICAL FIELD

The field of the invention generally relates to a two piece replacement oil pan plug assembly that permits easy removal and replacement of the plug for changing engine oil.

BACKGROUND

Internal combustion engine oil pans are provided with threaded drain plugs whereby engine oil may be drained from the oil pan. However, repeated removal and insertion of the threaded drain plugs sometimes results in the threads in the oil pan being damaged to the extent that the threaded plug may no longer form a fluid-tight closure for the oil pan drain bore. Accordingly, various forms of replacement plug assemblies previously have been provided.

Some of these replacement plug assemblies include lengthwise stretchable, and thus radially contractable, resilient plugs, self-threading plugs and plastic plugs, or plug members configured for slidable lengthwise retraction from the sleeve bore. However, these previously known forms of replacement plugs are either difficult to remove when an oil change becomes necessary, require special tools for removal and/or insertion and are themselves limited in effective life span. Accordingly, a need exists for an improved form of replacement oil pan plug which may be repeatedly removed with ease and enjoy an extended expected lifetime of effective operation.

Various forms of plugs, couplings and other structures including some of the general structural and operational features of the instant invention are disclosed in U.S. Pat. Nos. 2,824,945, 2,935,338, 3,097,867, 3,229,069, 3,422,390, 3,423,110, 3,761,117 and 4,205,758. However, these previously known structures are believed to fail to provide an effective readily removable and repeatedly usable replacement oil pan plug, or describe a structure that can be improved.

SUMMARY

The easy grip, threadless oil pan plug assembly of the instant invention includes a tubular sleeve for sealed securement through the drain opening of an oil pan and a plug member including a head and an elongated shank projecting lengthwise outwardly from one side of the head and removably telescopingly received in the sleeve from the end thereof on the exterior of the associated oil pan. The shank includes a seal structure for establishing a slidable fluid-tight seal between the shank, the sleeve bore and the exterior end portion of the sleeve. The head of the plug member includes an axially projecting skirt and an adjacent locking sleeve telescoped over the head and the skirt to releasably secure the plug member to the elongated sleeve. The locking sleeve is configured to permit the user to easily grip the sleeve and slide it along the plug member in the direction of the shank head to release the plug member from the oil pan.

One object of this invention is to provide an oil pan plug assembly which may be readily installed with a minimum of tools. Another object of this invention is to provide an easy grip oil pan plug assembly including a plug member that is easily grasped to be easily removed for ready draining of oil from the associated oil pan.

Another object of this invention, in accordance with the immediately preceding objectives is to provide an oil pan plug assembly including a plug member therefore which may be substantially instantly reinstalled after being removed and is automatically self-locking upon reinstallation.

Still another object of this invention is to provide an oil pan plug assembly including a removable plug member which may be readily removed and installed without the utilization of tools.

A final object of this invention is to provide a method of removing and replacing an oil pan plug assembly by mounting the tubular sleeve in an opening in the oil pan followed by mounting the plug member to the tubular sleeve to form a fluid tight seal.

In one implementation, there is provided an oil pan plug assembly that includes an elongated sleeve and a plug member. The elongated sleeve includes first and second ends and defines a longitudinal drain bore therethrough having corresponding first and second end portions, the second end of the sleeve configured to project outwardly from the exterior of the oil pan through an opening in the oil pan disposed about the sleeve, and a securement means for forming a fluid-tight seal through the opening in the oil pan when the sleeve is mounted in the oil pan. The plug member defines a head including an axially projecting skirt with a first and a second end, and an adjacent, axially projecting locking sleeve having a first end, a second end, and a middle section between the first and second ends having an outer diameter that is less than one or both of the first end and the second end. The locking sleeve surrounds the skirt and is telescoped over the skirt to releasably secure the plug member to the elongated sleeve by slidable lengthwise retraction from the sleeve bore. The plug member further comprises an elongated shank projecting length wise outwardly from one side of the enlarged head and is removably telescopingly received in the longitudinal bore second end portion of the elongated sleeve.

Embodiments of the oil pan plug assembly may include one or more of the following features. For example, the oil pan plug assembly may further include a seal means carried by the shank establishing a slidable fluid-tight seal between the shank and the one end portion of the bore, and the head and the exterior of the second end of the sleeve may include coacting means releasably securing the plug member against outward displacement relative to the second end of the sleeve and lengthwise retraction of the shank from the second end portion of the bore.

The middle section of the locking sleeve may have an outer diameter that is less adjacent the first end than the second end. The middle section of the locking sleeve may have an outer diameter that is less adjacent the second end than the first end. The middle section of the locking sleeve may have an outer diameter that changes over its length such that a minimum of the outer diameter is attained in a middle region of the middle section. The middle section of the locking sleeve may have a constant outer diameter over its length.

A transition between the first end and the middle section of the locking sleeve may form a gripping surface for sliding the locking sleeve. The middle section of the locking sleeve may have a textured outer surface, a ribbed outer surface or circumferential grooves.

The locking sleeve may have a rough surface intermediate its opposite ends. One or both of the first end and the second end of the locking sleeve may have a textured, roughened and/or ribbed surface.

The securement means comprises a retaining nut disposed around the elongated sleeve and the second end of the locking sleeve extends circumferentially over at least a portion of the retaining nut when the plug member is mounted to the elongated sleeve. The second end of the locking sleeve may cover the entirety of the retaining nut. The second end of the locking sleeve may cover a majority of the retaining nut. The second end of the locking sleeve may cover less than half of the retaining nut.

The securement means may include an enlarged head on the first end of the sleeve and a nut threaded on the second end of the sleeve. The enlarged head may be formed integrally with the sleeve. The securement means may include a resilient axially compressible and radially expandable sealing sleeve disposed on the elongated sleeve between the enlarged head and nut.

The oil pan plug may be installed in the oil pan of a vehicle. The oil pan plug may be installed in an oil pan.

In another general aspect, the method includes removing and replacing a replaceable oil pan plug. The method includes providing a replaceable oil pan plug assembly, mounting the elongated sleeve in an opening in the oil pan, and mounting the plug member to the elongated sleeve to form a fluid tight seal.

Mounting the plug member to the elongated sleeve to form a fluid tight seal includes gripping the middle section of the locking sleeve and sliding the locking sleeve in the direction of the head, sliding the sleeve into the sleeve bore, and releasing the middle section of the locking sleeve to form a fluid tight seal.

The replaceable oil pan plug assembly includes an elongated sleeve and a plug member. The elongated sleeve includes first and second ends and defines a longitudinal drain bore therethrough having corresponding first and second end portions, the second end of the sleeve configured to project outwardly from the exterior of the oil pan through an opening in the oil pan disposed about the sleeve, and a securement means for forming a fluid-tight seal through the opening in the oil pan when the sleeve is mounted in the oil pan. The plug member defines a head including an axially projecting skirt with a first and a second end, an adjacent, axially projecting locking sleeve having a first end, a second end, a middle section between the first and second ends having an outer diameter that is less than one or both of the first end and the second end, the locking sleeve surrounding the skirt and being telescoped over the skirt to releasably secure the plug member to the elongated sleeve by slidable lengthwise retraction from the sleeve bore, the plug member further comprising an elongated shank projecting length wise outwardly from one side of said enlarged head and removably telescopingly received in the longitudinal bore second end portion of the elongated sleeve.

Embodiments of the method may include one or more of the following features or those described above. For example, the method may further include removing the plug member from the elongated sleeve by gripping the middle section of the locking sleeve and sliding the locking sleeve in the direction of the head, and sliding the sleeve from the sleeve bore.

DESCRIPTION OF THE DRAWINGS

FIG. 4 is a cross-sectional side view of the locking sleeve of FIG. 1.

FIG. 5 is a perspective view of the sleeve portion of the oil pan plug assembly with the securing nut therefore removed.

FIGS. 6, 7, 9 and 10 each include a middle section that is of reduced diameter relative to one or both of the end sections of the locking sleeve such that there is an improved ability to grip and hold onto the sleeve when pulling the sleeve back to remove the sleeve from the plug assembly or re-mount the sleeve to the plug assembly.

DETAILED DESCRIPTION

The invention relates to an easily removable and replaceable oil pan plug assembly. As noted above, removable and replaceable oil pan plugs exist. However, the inventors have determined that such oil pan plugs can be improved for ease of handling and to prevent potential problems with their use. In particular, the inventors have modified an oil pan plug assembly generally described in U.S. Pat. No. 4,205,758, the contents of which are incorporated herein in their entirety for purposes of constructing and using the oil pan plug.

In particular, the disclosure of the '758 patent is incorporated herein by reference for its disclosure of various securement means for retaining the oil pan plug assembly in an oil pan. For example, the securement means can be made up of one or more nuts, washers and flanges or the like mounted temporarily or permanently on a sleeve mountable within an opening in an oil pan. For example, two pairs of nuts and washers can be used on a threaded sleeve on opposite sides of a wall of an oil pan. By tightening the nuts to reduce the space in between, a seal can be formed that permits oil to pass through the bore of the sleeve but not through the space between the outside surface of the sleeve and the opening in the oil pan. Similarly, one or more nuts can be mounted to the oil pan such that the threaded sleeve can be mounted in a sealed manner within the bore. In another embodiment, the sleeve can have a flange on one end that is positioned within the oil pan and a nut is threaded over the sleeve that is tightened against the oil pan and forms an oil tight seal. The nut can have a long sleeve that extends over the sleeve mounted through the opening in the oil pan. These are but some of the variations possible as known in the art to form an oil tight seal through the opening in the oil pan.

While the oil pan plug of the '758 patent can be used in engines, the inventors have worked with this oil pan plug and found a number of improvements that can be made which will provide great advantages to consumers, users, and mechanics. In particular, the inventors have improved a locking sleeve that is used on the oil pan plug to better allow the sleeve to be gripped and/or prevent the oil pan plug assembly from being damaged. The '758 patent is incorporated herein for the teaching of the oil pan plug assemblies disclosed herein with the exception of the configuration of the locking sleeve which has been improved upon by the inventor.

Figure 1:
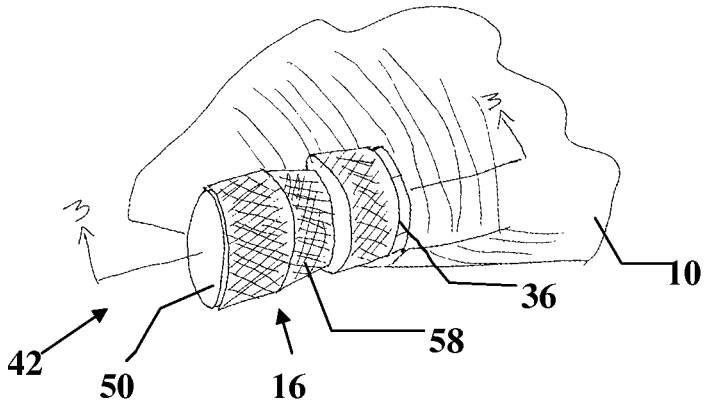
FIG. 1 is a perspective view of the drain plug area of a conventional oil pan with a plug assembly of the present invention.
Figure 2:
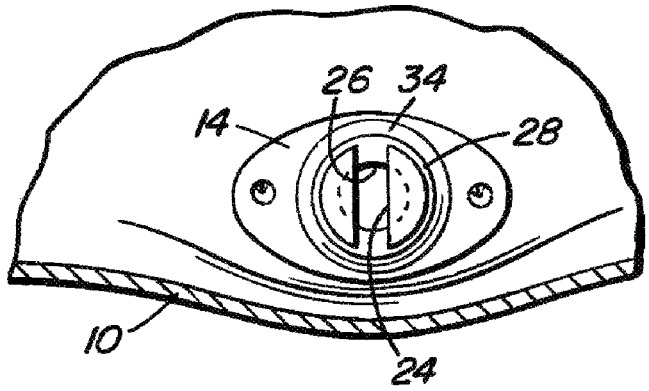
FIG. 2 is a vertical sectional view of the oil pan plug assembly illustrated in FIG. 1 as seen from the inside of the oil pan.
Figure 3:
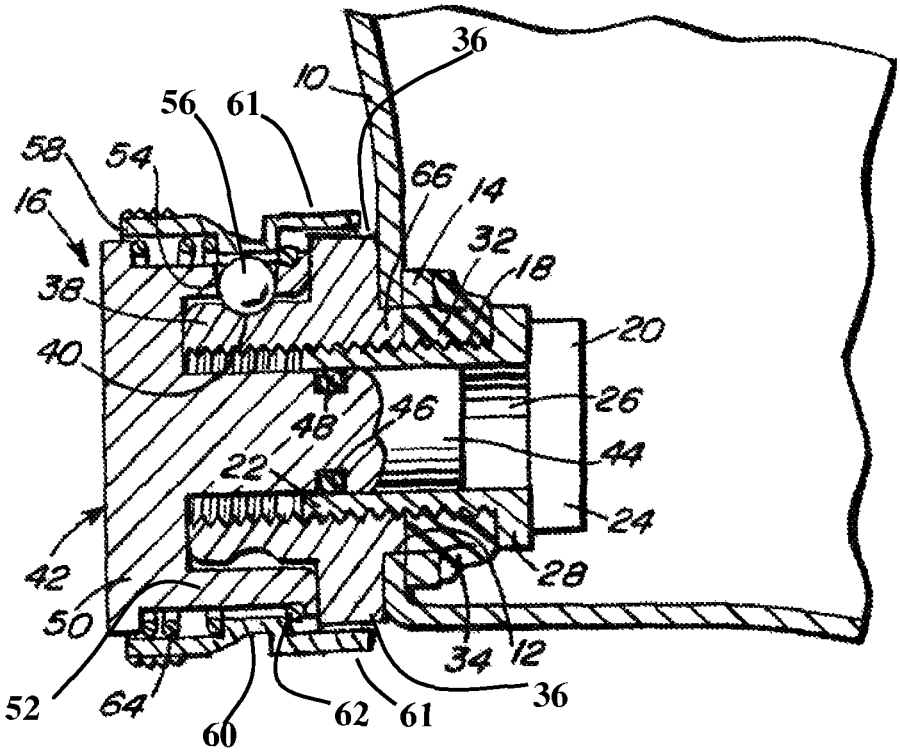
FIG. 3 is a cross-sectional side view the drain plug area of a conventional oil pan with a plug assembly constructed in accordance with the present invention taken along section lines 3-3 of FIG. 1.

Referring to FIGS. 1-3, an oil pan plug assembly 16 is illustrated that can be removably inserted into an oil pan. The numeral 10 generally designates an oil pan having a conventional drain opening 12 formed therein. An annular reinforcing member 14 is secured to the inner surface of the oil pan 10. Conventionally, the drain opening and reinforcing member are internally coextensively threaded to receive a conventional threaded oil pan plug. However, referring specifically to FIG. 3, the threads in the drain opening 12 and the reinforcing member 14 sometimes become damaged and are no longer capable of retaining a conventional threaded oil pan in tightly closed position sealing the drain opening 12. In such a situation, a removably insertable oil pan plug can advantageously be used in this situation. Of course, a removably insertable oil pan plug can be used in other situations as well, such as a standard part on a new car, a replacement part to increase the ease of oil changes, etc.

The basic form of a replacement plug assembly is referred to in general by the reference numeral 16 and includes an elongated sleeve 18 including first and second ends 20 and 22. The first end 20 of the sleeve 18 is provided with a diametric slot 24 and the sleeve defines a central longitudinal bore 26 opening outwardly of the second end 22 of the sleeve and terminating inwardly of the first end 20 of the sleeve 18, but opening into the slot 24. The sleeve 18 includes an enlarged head 28 adjacent the first end thereof and is externally threaded as at 30 from the head 28 to the second end 22 of the sleeve 18.

A resilient combined sleeve and washer 32 constructed of any suitable material such as neoprene is threaded onto the exterior of the sleeve 18 and includes a circumferentially extending and axially projecting flange 34. A retaining nut 36 is provided and includes a diametrically reduced sleeve portion 38 projecting outwardly from one end thereof and the sleeve portion 38 includes a circumferential groove 40.

As explained above, the elongated sleeve can be mounted within the oil pan by a number of different methods. For example, the elongated sleeve portion of the oil pan plug assembly can be threadably received into the oil pan. Other methods can be used as are well-known in the art.

A plug member referred to in general by the reference numeral 42 is also provided and includes a cylindrical shank 44 having a circumferential groove 46 and an O-ring 48 seated in the groove 46. The groove 46 is formed in the shank 44 centrally intermediate its opposite ends and one end of the shank 44 includes a diametrically enlarged head 50 including an axially projecting cylindrical skirt 52 provided with circumferentially spaced inwardly tapering radial bores 54 in which spherical lock members 56 are seated.

A locking sleeve 58 is telescoped over the exterior of the head 50 and the skirt 52 and includes a diametrically reduced mid-portion 60 retained on the skirt 52 at one end by a locking ring 62 and spring-biased by spring 64 toward a position with the diametrically reduced portion 60 engaged with the locking ring 62 by a compression spring 64. The compression spring 64, when totally compressed, limits shifting of the locking sleeve 58 to the left relative to the head 50 as viewed in FIG. 3 and the locking ring 62 limits shifting of the locking sleeve 58 to the right as viewed in FIG. 3. When the locking sleeve 58 is shifted to its limit of movement to the left as viewed in FIG. 3 against the collapsed spring 64, the diametrically reduced portion 60 of the locking sleeve 58 uncovers the outer sides of the spherical members 56 and thus enables the latter to unseat themselves from the groove 40 to thereby enable the plug member 42 to be withdrawn from the sleeve 18. Of course, an outward pull on the locking sleeve 58 releases the plug member 42 for disengagement from the sleeve 44 and the nut 36 and thereby enables merely an outward pull on the locking sleeve 58 to effect total disengagement of the plug member 42 from the sleeve 18.

When it is desired to reinstall the plug member 42, the sleeve 58 is shifted to its limit position of movement to the left as viewed in FIG. 3 of the drawings, and the plug member 42 is then inserted into the sleeve 18. Thereafter, the locking sleeve 58 may be released in order that the diametrically reduced portion 60 may cam the lock members 56 into seated engagement in the groove 40.

The locking sleeve 58 also has an end 61 that is of a length to cover the majority of the nut 36 when the plug member 42 is installed in the oil pan. This covering of the nut 36 is intended to prevent a mechanic from misunderstanding how the oil pan plug assembly 16 is mounted to the oil pan. In some instances it is expected that a mechanic might not recognize that the plug member 42 is intended to be removed without the use of tools and would try to use a wrench to remove the plug assembly 16. Because the locking sleeve has an end 61 that interacts with the plug member 42 to cover the majority of the nut 36, the mechanic will not be inclined to use a wrench to remove the plug member. Instead, it is anticipated that a mechanic who is not familiar with the oil pan plug assembly 16 will examine the assembly 16 and recognize that it should be removed by pulling back on the locking sleeve 58 such that the plug member 42 can be removed from the sleeve portion 38 and oil pan.

The O-ring seal 48 establishes a fluid-tight seal between the shank 44 and the bore 26 and the flange 34 and radial expansion of the combined sleeve and the washer 32 effect a fluid-tight seal between the sleeve 18 and the annular reinforcing member 14.

Figure 3A:
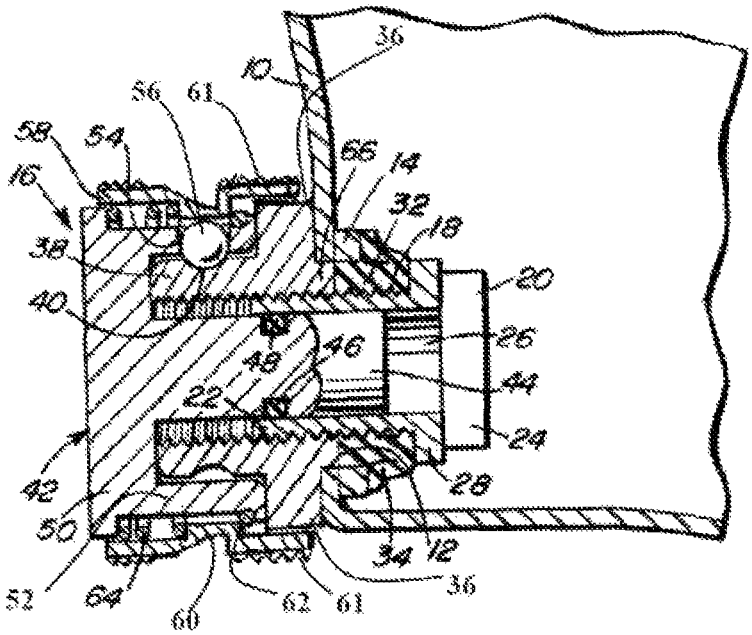
FIG. 3A a cross-sectional side view the drain plug area of a conventional oil pan with a plug assembly taken along section lines 3-3 of FIG. 1 in which the first end and the second end of the locking sleeve has a textured surface.

FIG. 3A like FIG. 3, shows the cross-sectional side view the drain plug area of a conventional oil pan with a plug assembly taken along section lines 3-3 of FIG. 1. FIG. 3A, shows both the first end and the second end of the locking sleeve as having a textured surface while FIG. 3 shows only the first end of the locking sleeve as having a textured surface.

Figure 3B:
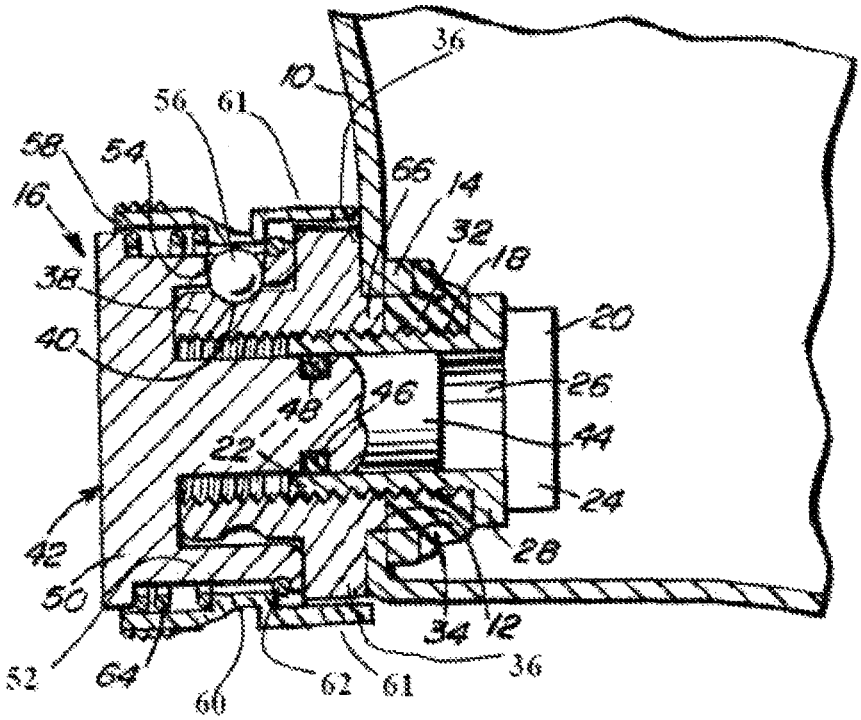
FIG. 3B a cross-sectional side view the drain plug area of a conventional oil pan with a plug assembly taken along section lines 3-3 of FIG. 1 in which the locking sleeve extends over the entirety of the securement nut.
Figure 3C:
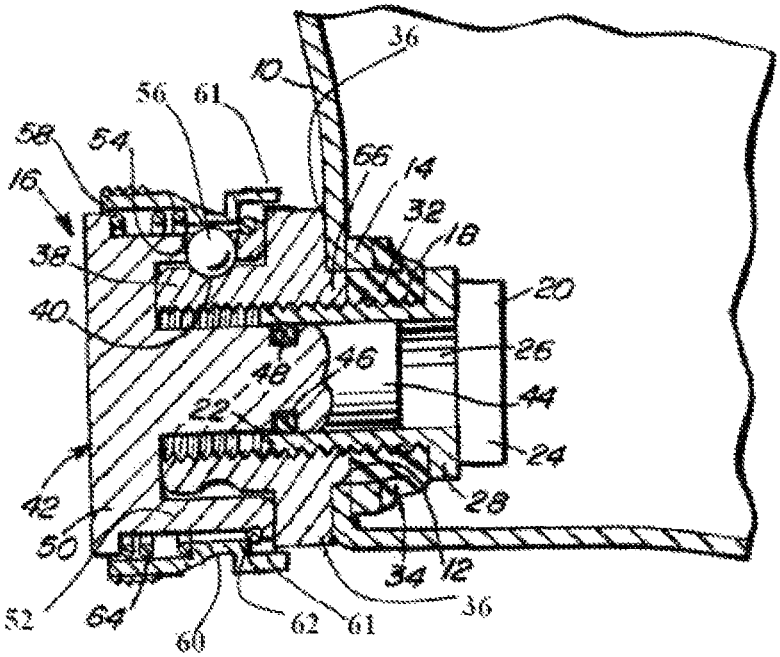
FIG. 3C a cross-sectional side view the drain plug area of a conventional oil pan with a plug assembly taken along section lines 3-3 of FIG. 1 in which the locking sleeve extends over less than half of the securement nut.

FIG. 3B shows the locking sleeve 58 in which the end 61 is of a length to cover the entirety of the securement nut 46 when the plug member 42 is installed in the oil pan. FIG. 3C shows the locking sleeve 58 in which the end 61 is of a length to cover less than half of the securement nut 46 when the plug member 42 is installed in the oil pan.

Referring also to FIG. 4, which illustrates the locking sleeve 58 in cross-section, the sleeve includes the end 61 which is of a length to cover the majority of the nut 36 when the plug member 42 is installed in the oil pan. The sleeve 58 also includes an end 70 which covers a portion of the head 50 of the plug member, and the narrowed diameter section 60. The diameter of section 60 is reduced in both the inner diameter and the outer diameter. In this manner, an individual removing the plug member 42 has a region in which to securely grasp the locking sleeve 58 to slide back the sleeve over the plug member and release it from the sleeve 38. The reduced diameter section 60 advantageously allows the mechanic to remove the sleeve even when the sleeve has oil on its surface. As can be imagined, if the section 60 was of the same outer diameter as the ends 61 and 70, a mechanic would not have the ability to securely grip the sleeve to slide it back. This inability to securely grip the sleeve would be exacerbated if the surface had oil on it.

FIG. 4 also illustrates that a surface 74 of the section 60 has a ribbed surface. This surface 74 improve the grip of the mechanic to grasp the sleeve 58. The ribbed surface 74 can be modified to have any textured surface that enhances a mechanic's grip on the sleeve. Further, FIG. 4 illustrates that a portion of the surface 74 is without a ribbed surface. Such a surface can be ribbed or otherwise textured to improve the ability of the mechanic to remove the sleeve. Similarly, surfaces 72 and 76 can be formed with a textured surface to enhance the ability to grip the locking sleeve 58. The texture can be ribs, grooves, a knurled surface, a roughened surface and the like.

From FIG. 5 of the drawings, it may be seen that the flange 34 is collapsible into a substantially cylindrical condition within an annular recess provided therefore and with an outside diameter substantially equal to the outside diameter of the cylindrical head 28. When it is desired to install the oil pan plug assembly 16, the assemblage comprising the sleeve 18 and the combined sleeve and washer 32 is inserted into the opening 12 and the annular reinforcing member 14. Then, when the flange 34 has cleared the inner side of the reinforcing member 14, the nut 36 is threaded onto the end of the sleeve 18 remote from the head 28 on the exterior of the pan 10. The nut 36 includes a diametrically reduced portion 66 which is snugly received within the drain opening 12 and the combined sleeve and washer is axially compressed and radially expanded between the head 28 and the nut 36 so as to tightly expand within the reinforcing member 14. Further, as the nut 36 is tightened, the head 28 is drawn toward the reinforcing member 14 and the flange 34 has its free end flexed outward and expanded over the inner end of the annular reinforcing member 14. Thus, a reliable fluid tight seal is defined between the sleeve 18 and the reinforcing member 14. Once the sleeve 18, combined sleeve and washer 32 and nut 36 have been installed, it is merely necessary to insert the plug member 42 in the manner hereinbefore set forth.

It is also pointed out that the slot 24 is sufficiently narrow that the blade of a conventional screwdriver of a size to be received through the bore 26 may be received in the slot 24. When the nut 36 is tightened during installation of the sleeve 18, the aforementioned screwdriver blade may be utilized to hold the sleeve 18 against rotation while the nut 36 is tightened.

Figure 6:
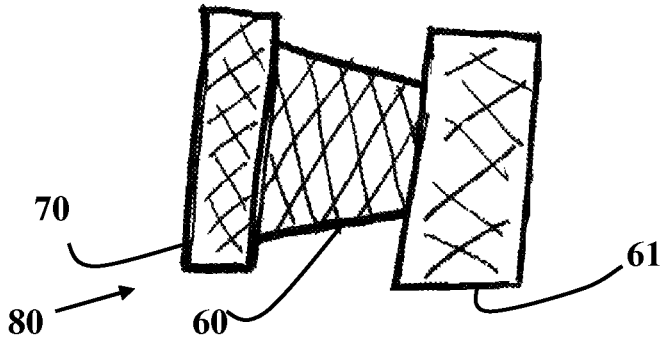
FIGS. 6-10 are side views of additional embodiments of the locking sleeve for the oil pan plug assembly. Each embodiment includes a textured surface to enhance the ability to grip the locking sleeve. Each embodiment also includes a section that covers a portion of a nut that retains the plug assembly to the oil pan.

It also should be understood that the locking sleeve 58 illustrated in FIGS. 1-4 may be modified to achieve the objectives described above. For example, referring to FIG. 6, a locking sleeve 80 can be configured such that the reduced diameter section 60 has a reduction in outer diameter over its length from the head section 70 to the section 61 that covers the nut 36. The surfaces of one or more of the different sections can be smooth or textured to enhance gripability of the locking sleeve. Further, because there will be a ridge formed at the intersection of the head section 70 and the section 60, there will be enhanced gripability of the locking sleeve.

Figure 7:
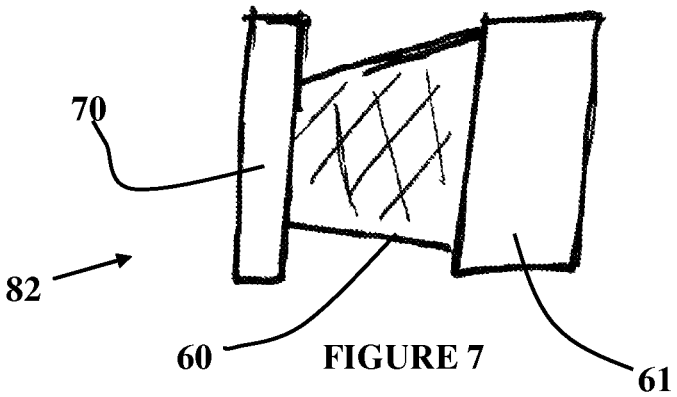

Similarly, referring to FIG. 7, a locking sleeve 82 can have a reverse configuration from that of the locking sleeve 80 by having the reduced diameter section 60 has a reduction in outer diameter over its length from the section 61 that covers the nut 36 in the direction of the section 70 that covers the head. The surfaces of one or more of the different sections can be smooth or textured to enhance gripability of the locking sleeve. Further, because there will be a ridge formed at the intersection of the head section 70 and the section 60, there will be enhanced gripability of the locking sleeve.

Figure 8:
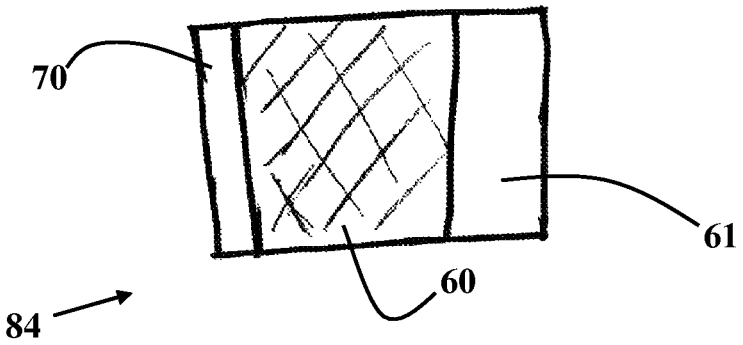

Referring to FIG. 8, a locking sleeve 84 has a constant outer diameter along its length. The section 60, rather than being of a reduced diameter relative to the sections 61 and 70, has a textured surface that permits the user to more easily grasp the sleeve. Advantageously, in this embodiment and the other embodiments of FIGS. 6-10, the section 61 covers the nut 36 to ensure that a mechanic does not attempt to remove the oil plug assembly using a wrench.

Figure 9:
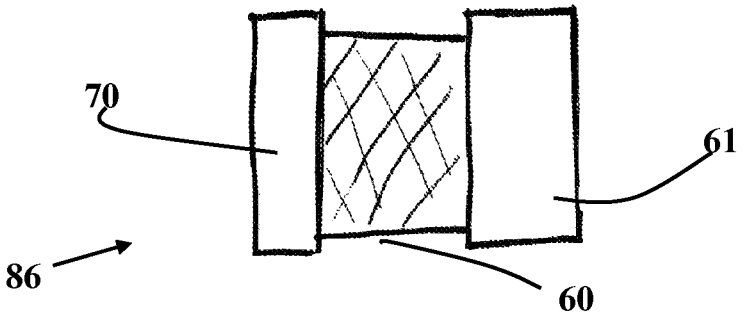

Referring to FIG. 9, in an embodiment similar to that disclosed in FIG. 8, a locking sleeve 86 has a constant outer diameter section 60 that is of a reduced diameter in comparison to one or both of the sections 61 and 70. FIG. 9 illustrates the section 60 having a reduced section in comparison to both sections 61 and 70. One or all of the surfaces can be textured to enhance gripability of the sleeve. Further, because there will be a ridge formed at the intersection of the head section 70 and the section 60, there will be enhanced gripability of the locking sleeve.

Figure 10:
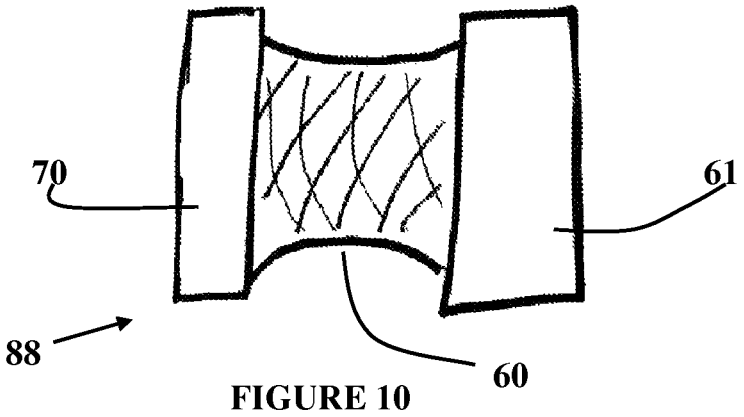

Referring to FIG. 10, a locking sleeve 88 has a reduced outer diameter section 60 that is of a reduced diameter in comparison to one or both of the sections 61 and 70 and also in comparison to its entire length. The narrowest outer diameter is in the mid-section, which allows improved ability to grip the sleeve and slid it along the plug member. One or all of the surfaces can be textured to enhance gripability of the sleeve. Further, because there can be a ridge formed at the intersection of the head section 70 and the section 60, there will be enhanced gripability of the locking sleeve.

In another embodiment of this invention, in accordance with the preceding embodiments, circumferentially spaced radial grooves can be formed on the external surface of the locking sleeve at any location along its length, e.g., intermediate its opposite ends for a better grip. In a still another embodiment the radial grooves are replaced by a rough surface for a better grip.

Still another embodiment of the invention describes a method of removing and replacing an oil pan plug assembly. The method includes the steps of (1) Providing a replaceable oil pan plug as described herein, (2) Mounting the elongated sleeve in an opening in the oil pan; and (3) Mounting the plug member to the elongated sleeve to form a fluid tight seal with a portion of the plug member covering a majority of a nut used to mount the elongated sleeve in the opening in the oil pan. Mounting the plug member comprises placing one or more fingers on the intermediate narrowed outer diameter and/or rough or grooved section of the locking sleeve between two flanges, gripping and pressing the locking sleeve to its limit position of movement towards the head, placing and pressing the thumb on the head portion and thereby securing the plug member into the elongated sleeve by slidable lengthwise compression into the sleeve bore.

What is claimed is:

1. An oil pan plug assembly for mounting to an opening in an oil pan, the assembly comprising:

an elongated sleeve including first and second ends and defining a longitudinal drain bore therethrough having corresponding first and second end portions, the second end of the sleeve configured to project outwardly from an exterior surface of an oil pan through an opening in the oil pan disposed about the sleeve when the assembly is mounted to an oil pan, and a securement means for forming a fluid-tight seal through the opening in the oil pan when the sleeve is mounted in the oil pan;

a plug member defining a head including an axially projecting skirt with a first and a second end, an adjacent, axially projecting, axial movable locking sleeve having a first end, a second end, and a middle section between the first and second ends, the second end having an inner diameter and the middle section having an outer diameter that is less than an outer diameter of one or both of the first end and the second end, the locking sleeve surrounding the skirt and being telescoped over the skirt to releasably secure the plug member to the elongated sleeve by slidable lengthwise retraction from the sleeve bore, the plug member further comprising an elongated shank projecting length wise outwardly from one side of said enlarged head and removably telescopingly received in the longitudinal bore second end portion of the elongated sleeve, wherein the securement means comprises a retaining nut disposed around the elongated sleeve and has an outer diameter that is less than the inner diameter of the second end of the locking sleeve whereby the second end of the locking sleeve extends circumferentially over at least a portion of the retaining nut when the plug member is mounted to the elongated sleeve, and whereby when the assembly is mounted to an oil pan, at least a portion of a circumference of the retaining nut is surrounded by the second end of the locking sleeve.

2. The oil pan plug assembly of claim 1, further comprising a seal means carried by the shank establishing a slidable fluid-tight seal between the shank and the one end portion of the bore, and the head and the exterior of the second end of the sleeve including coacting means releasably securing the plug member against outward displacement relative to the second end of the sleeve and lengthwise retraction of the shank from the second end portion of the bore.

3. The oil pan plug assembly of claim 1, wherein the middle section of the locking sleeve has an outer diameter that is less adjacent the first end than the second end.

4. The oil pan plug assembly of claim 1, wherein the middle section of the locking sleeve has an outer diameter that is less adjacent the second end than the first end.

5. The oil pan plug assembly of claim 1, wherein the middle section of the locking sleeve has an outer diameter that changes over its length such that a minimum of the outer diameter is attained in a middle region of the middle section.

6. The oil pan plug assembly of claim 1, wherein the middle section of the locking sleeve has a constant outer diameter over its length.

7. The oil pan plug assembly of claim 1, wherein a transition between the first end and the middle section of the locking sleeve forms a gripping surface for sliding the locking sleeve.

8. The oil pan plug assembly of claim 1, wherein the middle section of the locking sleeve has a textured outer surface.

9. The oil pan plug assembly of claim 1, wherein the middle section of the locking sleeve has a ribbed outer surface or circumferential grooves.

10. The oil pan plug assembly of claim 1, wherein the locking sleeve has a rough surface intermediate its opposite ends.

11. The oil pan plug assembly of claim 1, wherein one or both of the first end and the second of the locking sleeve has a textured, roughened and/or ribbed surface.

12. The oil pan plug assembly of claim 1, wherein the second end of the locking sleeve covers the entirety of the retaining nut.

13. The oil pan plug assembly of claim 1, wherein the second end of the locking sleeve covers a majority of the retaining nut.

14. The oil pan plug assembly of claim 1, wherein the second end of the locking sleeve covers less than half of the retaining nut.

15. The oil pan plug of claim 1 wherein said securement means includes an enlarged head on said first end of said sleeve and a nut threaded on the second end of said sleeve.

16. The oil pan plug of claim 15 wherein said enlarged head is formed integrally with said sleeve.

17. The oil pan plug of claim 1, wherein the oil pan plug is installed in the oil pan of a vehicle.

18. A method of removing and replacing an oil pan plug, the method comprising:

providing a replaceable oil pan plug assembly according to claim 1;

mounting the elongated sleeve in an opening in the oil pan;

mounting the plug member to the elongated sleeve to form a fluid tight seal, wherein mounting the plug member comprises gripping the middle section of the locking sleeve and sliding the locking sleeve in the direction of the head, sliding the sleeve into the sleeve bore, releasing the middle section of the locking sleeve to form a fluid tight seal.

19. The method of claim 18, further comprising removing the plug member from the elongated sleeve by gripping the middle section of the locking sleeve and sliding the locking sleeve in the direction of the head, and sliding the sleeve from the sleeve bore.

20. The oil pan plug assembly of claim 1, wherein the locking sleeve is movable between a first position in which the second end of the sleeve covers at least a portion of a circumference of the retaining nut and a second position in which the second end of the sleeve does not cover the circumference of the retaining nut, and the sleeve has a bias to cover the retaining nut such that the sleeve must be retracted against the bias to uncover the circumference of the retaining nut.

* * * * *